US008632323B2

(12) United States Patent
Uozumi et al.

(10) Patent No.: US 8,632,323 B2
(45) Date of Patent: Jan. 21, 2014

(54) INTERNAL GEAR PUMP ROTOR, AND INTERNAL GEAR PUMP USING THE ROTOR

(75) Inventors: Masato Uozumi, Itami (JP); Harumitsu Sasaki, Itami (JP); Kentaro Yoshida, Itami (JP); Yuichirou Egami, Takahashi (JP)

(73) Assignee: Sumitomo Electric Sintered Alloy, Ltd., Takahashi-shi (JP)

( * ) Notice: Subject to any disclaimer, the term of this patent is extended or adjusted under 35 U.S.C. 154(b) by 751 days.

(21) Appl. No.: 12/682,025

(22) PCT Filed: Aug. 4, 2009

(86) PCT No.: PCT/JP2009/063779
§ 371 (c)(1),
(2), (4) Date: Apr. 7, 2010

(87) PCT Pub. No.: WO2010/016473
PCT Pub. Date: Feb. 11, 2010

(65) Prior Publication Data

US 2010/0209276 A1 Aug. 19, 2010

(30) Foreign Application Priority Data

Aug. 8, 2008 (JP) ..... 2008-205311

(51) Int. Cl.

| | |
|---|---|
| ***F01C 1/10*** | (2006.01) |
| ***F03C 2/00*** | (2006.01) |
| ***F03C 4/00*** | (2006.01) |
| ***F16H 55/00*** | (2006.01) |

(52) U.S. Cl.
USPC ..... 418/150; 418/171; 418/166; 74/462

(58) Field of Classification Search
USPC ..... 418/150, 166, 171; 74/462; 33/288
See application file for complete search history.

(56) References Cited

U.S. PATENT DOCUMENTS

| | | | | |
|---|---|---|---|---|
| 2,421,463 | A * | 6/1947 | Noreyko | 74/462 |
| 2,960,884 | A * | 11/1960 | Hill | 74/462 |
| 4,350,480 | A * | 9/1982 | Bammert | 418/201.3 |
| 4,657,492 | A * | 4/1987 | Saegusa | 418/150 |
| 5,368,455 | A * | 11/1994 | Eisenmann | 418/171 |

(Continued)

FOREIGN PATENT DOCUMENTS

| | | |
|---|---|---|
| CN | 1442615 A | 9/2003 |
| CN | 1532403 A | 9/2004 |

(Continued)

*Primary Examiner* — Kenneth Bomberg
*Assistant Examiner* — Deming Wan
(74) *Attorney, Agent, or Firm* — Venable LLP; Michael A. Sartori; Tamatane J. Aga

(57) ABSTRACT

A gear pump rotor is provided including a combination of an inner rotor and an outer rotor whose numbers of teeth are different by one, and the discharge amount of the pump is increased by an increase of the tooth depth. At least one of an addendum curve and a dedendum curve of an inner rotor is formed by a locus of one point on formation circles that satisfy moving conditions that the formation circles move from moving start points to moving end points while changing the distances from an inner rotor center to the centers of the formation circles. The centers of the formation circles move by a distance in the radial direction of a base circle, and the formation circles rotate by an angle at a constant angular velocity in the same directions of the moving directions of the formation circles.

7 Claims, 13 Drawing Sheets

(56) References Cited

U.S. PATENT DOCUMENTS

| | | | | |
|---|---|---|---|---|
| 5,605,518 | A * | 2/1997 | Kogure et al. | 475/344 |
| 5,628,626 | A * | 5/1997 | Hansen | 418/61.3 |
| 5,772,419 | A * | 6/1998 | Hansen et al. | 418/61.3 |
| 6,077,059 | A * | 6/2000 | Hosono | 418/150 |
| 6,101,892 | A * | 8/2000 | Berlinger et al. | 74/462 |
| 6,244,843 | B1 * | 6/2001 | Kosuge | 418/150 |
| 6,890,164 | B2 * | 5/2005 | Ogata et al. | 418/150 |
| 6,893,238 | B2 * | 5/2005 | Eisenmann et al. | 418/171 |
| 6,902,507 | B2 * | 6/2005 | Ballard | 475/168 |
| 6,929,458 | B2 * | 8/2005 | Hirabayashi et al. | 418/150 |
| 7,118,359 | B2 * | 10/2006 | Hosono | 418/150 |
| 8,096,795 | B2 * | 1/2012 | Ono et al. | 418/150 |
| 2004/0022660 | A1 | 2/2004 | Eisenmann et al. | |
| 2004/0191101 | A1 * | 9/2004 | Ogata et al. | 418/171 |
| 2006/0239848 | A1 * | 10/2006 | Hosono | 418/150 |

FOREIGN PATENT DOCUMENTS

| | | | |
|---|---|---|---|
| CN | 1740569 | A | 3/2006 |
| JP | 61-201892 | | 9/1986 |
| JP | 2007-255292 | | 10/2007 |

* cited by examiner (a)

(b)

(a)

(b)

(a)

(b)

(a)

(b)

(a)

(b)

(a)

(b)

(a)

(b)

INTERNAL GEAR PUMP ROTOR, AND INTERNAL GEAR PUMP USING THE ROTOR

TECHNICAL FIELD

The present invention relates to an internal gear pump rotor including in combination an inner rotor and an outer rotor whose numbers of teeth are different by one, and to an internal gear pump using the rotor. More specifically, the present invention can increase the theoretical discharge amount of the pump by allowing flexibility in setting the depth and number of teeth.

BACKGROUND ART

Internal gear pumps are used, for example, as oil pumps for lubrication of a car engine and for an automatic transmission (AT). In some pump rotors adopted in the internal gear pumps, inner and outer rotors, whose numbers of teeth are different by one, are combined. Further, in some rotors of this type, the tooth profile of the rotor is formed by a trochoidal curve, or the tooth profile of the rotor is formed by a cycloidal curve.

As shown in FIG. 15, a tooth profile using a trochoidal curve is formed using a base circle E and a rolling circle F that does not slip, but rolls on the base circle E. More specifically, a trochoidal curve TC is drawn by a locus of one point on a radius at a distance e (=amount of eccentricity between the centers of an inner rotor and an outer rotor) from the center of the rolling circle F, and a tooth profile of an inner rotor 2 is formed by an envelope of a group of arcs of a locus circle G that moves on the trochoidal curve TC, has the center on the trochoidal curve, and has a fixed diameter (see the following Patent Document 1).

As for a tooth profile defined by a cycloidal curve, a tooth profile of an inner rotor is formed by a base circle, a locus of one point on the circumference of an externally rolling circle that does not slip, but rolls on the base circle while being circumscribed about the base circle, and a locus of one point on the circumference of an internally rolling circle that does not slip, but rolls on the base circle while being inscribed in the base circle.

RELATED ART DOCUMENT

Patent Document

Patent Document 1: Japanese Unexamined Patent Application Publication No. 61-201892

SUMMARY OF THE INVENTION

Problems to be Solved by the Invention

For one tooth profile using a trochoidal curve, one base circle E, one rolling circle F, one locus circle G, and one amount of eccentricity e are set. While it is only necessary to increase the tooth depth in order to increase the discharge amount of a pump having the tooth profile, when the amount of eccentricity e between the inner rotor and an outer rotor is increased to increase the tooth depth, the tooth width becomes too small or it becomes impossible to design the tooth profile. Therefore, the amount of eccentricity e is restricted, and the tooth depth is limited. For this reason, it is difficult to meet the demand to increase the discharge amount.

Further, even when the tooth depth remains the same, the discharge amount can be increased by increasing the number of teeth. However, when the number of teeth increases, the radial dimension of the rotor increases. Thus, it is difficult to meet the demand to increase the discharge amount without changing the outer diameter of the rotor.

This also applies to an internal gear pump that adopts a tooth profile defined using a cycloidal curve. In the pump of this type, the number of teeth of the rotor is determined by the diameter of a base circle and the diameters of an externally rolling circle and an internally rolling circle which form the tooth profile by rolling on the base circle without slipping thereon. Further, since the tooth depth of the rotor is determined by the diameters of the externally rolling circle and the internally rolling circle, the discharge amount of the pump depends on the diameters of the base circle and the rolling circles. For this reason, the degree of flexibility in setting the tooth depth and the number of teeth is low, and it is difficult to meet the demand to increase the discharge amount of the pump.

In addition, in the internal gear pump, as the number of teeth increases, the number of discharge operations from a pump chamber (pumping chamber) performed during one rotation of the inner rotor increases. Hence, pulsation of discharge pressure decreases. However, when the number of teeth is increased while satisfying the discharge amount in the conventional internal gear pump, as described above, the rotor size increases. Therefore, the increase in number of teeth is restricted.

An object of the present invention is to increase the discharge amount of a pump and to suppress discharge pulsation by allowing flexibility in setting the tooth depth of a pump rotor that includes in combination an inner rotor and an outer rotor whose numbers of teeth are different by one.

Means for Solving the Problems

In order to achieve the above object, in the present invention, an internal gear pump rotor including an inner rotor having n-number of teeth and an outer rotor having (n+1)-number of teeth in combination is configured as follows.

That is, formation circles B and C move in a manner such as to satisfy the following conditions, and at least one of an addendum curve and a dedendum curve of a tooth profile is formed by a locus curve drawn, during the movement, by one point j that coincides with a reference point J on a base circle A concentric with an inner rotor center $O_I$ and that is on the formation circles B and C.

—Moving Conditions of Formation Circles B and C—

While changing distances between the inner rotor center $O_I$ and centers pa of the formation circles by a distance R, the centers pa of the formation circles B and C move from moving start points Spa and Spb where the centers are positioned when the formation circles B and C are arranged so that the point j coincides with the reference point J on the base circle A, to moving end points Lpa and Lpb where the centers are positioned when the formation circles B and C are arranged so that the point j is positioned at an addendum top $T_T$ or a dedendum bottom $T_B$. During this, the formation circles B and C rotate through an angle θ at a constant angular velocity in the same direction as moving directions of the circles.

As the formation circles B and C, two circles, that is, a circle whose center moves from the moving start point to the moving end point while keeping its diameter Bd or Cd fixed, and a circle whose center moves from the moving start point to the moving end point while decreasing its diameter Bd or Cd, are conceivable. An appropriate one of the formation circles can be selected in consideration of the required performance of the pump.

In the internal gear pump rotor, preferably, the centers pa of the formation circles move on curves $AC_I$ and $AC_2$ where a change rate of the distances between the inner rotor center $O_I$ and the centers of formation circles is 0 at the moving end points Lpa and Lpb.

Preferably, the curves $AC_1$ and $AC_2$ are curves using a sine function. For example, the curves $AC_1$ and $AC_2$ are curves in which the displacement value ΔR of the distance from the inner rotor center $O_I$ satisfies the following expression:

$$\Delta R = R \times \sin(\pi/2 \times m/S_T)$$

where $S_T$ is the number of steps and $m=0 \rightarrow S_T$.

Assuming that a straight line connecting the reference point J on the base circle A and the inner rotor center $O_I$ is designated as $L_1$, an addendum top $T_T$ is set on a straight line $L_2$ turned by an angle $\theta_T$ from the straight line $L_1$, and a dedendum bottom $T_B$ is set on a straight line $L_3$ turned by an angle $\theta_B$ from the straight line $L_1$. Further the angle $\theta_T$ between the straight line $L_1$ and the straight line $L_2$ and the angle $\theta_B$ between the straight line $L_1$ and the straight line $L_3$ are set in consideration of, for example, the number of teeth and the ratio of setting areas of an addendum and a dedendum.

The moving start point Spa of the center of the addendum formation circle B and the moving start point Spb of the center of the dedendum formation circle C are on the straight line $L_1$. Further, the moving end points Lpa and Lpb thereof are on the straight lines $L_2$ and $L_3$, respectively.

The present invention also provides an internal gear pump rotor including an inner rotor having the above-described tooth profile and the following outer rotor in combination.

A tooth profile of the outer rotor is determined by the following steps:

A center $O_I$ of the inner rotor makes one revolution on a circle S centered on the center of the outer rotor and having a diameter (2e+t).

During this, the inner rotor makes a 1/n rotation.

An envelope of a group of tooth profile curves formed by the revolution and rotation of the inner rotor is drawn.

The envelope thus determined serves as the tooth profile.

Here:

e: amount of eccentricity between the center of the inner rotor and the center of the outer rotor t: tip clearance n: number of teeth of the inner rotor Here, the tip clearance is defined as follows:

First, the inner rotor is set in a state in which the inner rotor center is at the origin and an addendum top of the inner rotor is in a negative area on the Y-axis passing through the origin.

Next, the outer rotor is set in a state in which the center of the outer rotor is at one point on the Y-axis at a distance, which is equal to the amount of eccentricity e, from the origin and an addendum top of the outer rotor meets the addendum top of the inner rotor in the negative area on the Y-axis.

Then, from this state, the outer rotor center is moved on the Y-axis away from the inner rotor center until the tooth profile of the inner rotor and the tooth profile of the outer rotor come into contact with each other. At a measurement position of a tip clearance formed in this way, a clearance formed between the addendum top of the inner rotor on the Y-axis and the addendum top of the outer rotor on the Y-axis serves as the tip clearance t.

The present invention further provides an internal gear pump in which the above-described internal gear pump rotor of the present invention is stored in a rotor accommodating chamber provided in a pump housing.

When the addendum formation circle B and the dedendum formation circle C have diameters that change during movement, diameters $Bd_{max}$ and $Cd_{max}$ of the formation circles at the moving start points are set in consideration of the target tooth depth. Assuming that the change amounts of diameter of the formation circles between the moving start points and the moving end points are ΔBd and ΔCd, the addendum height and the dedendum depth for determining the tooth depth are given by the following expressions:

$$\text{addendum height} = R + (Bd/2) + \{(Bd - \Delta Bd/2)\}$$

$$\text{dedendum depth} = R + (Cd/2) + \{(Cd - \Delta Cd/2)\}$$

In these two expressions, R, Bd, ΔBd, Cd, and ΔCd are all numerical values that can be set arbitrarily. Adequate values of R, Bd, ΔBd, Cd, and ΔCd can be found, for example, by producing some tooth profile models in which these values are variously changed in consideration of the change rate of the moving distance R and selecting the best one from the models.

Appropriate diameters of the formation circles B and C at the moving end points Lpa and Lpb are more than or equal to 0.2 times the diameters at the moving start points Spa and Spb and less than or equal to the diameters at the moving start points Spa and Spb.

Advantages

For example, a tooth profile using a cycloidal curve is drawn by a locus of one point on each of an internally rolling circle and an externally rolling circle with a fixed diameter that roll on a base circle having a fixed diameter. To establish the tooth profile, the internally rolling circle and the externally rolling circle each must move around the base circle when making the same number of rotations as the number of teeth. For this reason, the shape of the rotor is determined by the diameter of the base circle, the diameters of the rolling circles, and the number of teeth. Since the tooth depth is determined by the diameters of the rolling circles for themselves, there is no flexibility in changing the tooth depth. This also applies to a tooth profile formed using a trochoidal curve.

In contrast, in the internal gear pump rotor of the present inventor, in the tooth profile of at least one of the addendum and the dedendum of the inner rotor, the formation circle does not roll on the base circle having a fixed diameter. While the formation circle rotates through the angle θ at a constant angular velocity, it does not roll on the base circle.

In FIG. 2 or 4, a distance $R_0$ from an inner rotor center of $O_I$ to the moving start point of an addendum formation circle B (=a moving start point Spa of the center of the circle), a distance $r_0$ from the inner rotor center $O_I$ to a moving start point of a dedendum formation circle C (=a moving start point Spb of the center of the circle), a distance $R_1$ from the inner rotor center $O_1$ to the center of an addendum formation circle B (=a moving end point Lpa) at the straight line $L_2$, and a distance $r_1$ from the inner rotor center $O_I$ to the center of the dedendum formation circle C (=a moving end point Lpb) at the straight line $L_3$ are set arbitrarily. The tooth depth can be arbitrarily changed by changing a distance difference between $R_0$ and $R_1$ and a distance difference between $r_0$ and $r_1$, that is, the radial moving distances R of the addendum and dedendum formation circles.

In particular, the tooth depth can be freely increased by setting the radial moving distances R at zero or more. The increase in tooth depth increases the capacity of a pump chamber defined between the teeth of the inner rotor and the outer rotor, and thereby increases the discharge amount of the pump.

In the internal gear pump rotor of the present invention, since conditions, such as the diameters of the formation circles, the radial moving distances of the formation circles, and the change rate of the distances, can be freely set, the degree of flexibility in designing the tooth profile also increases.

In particular, when the tooth profiles of the addendum and the dedendum of the inner rotor are formed using the formation circles that move while changing their diameters, they can be changed by changing the change amounts of diameter from the moving start points to the moving end points of the formation circles. Hence, the degree of flexibility in designing the tooth profile increases further.

Details of the straight lines $L_1$ to $L_3$, the moving start point Spa and the moving end point Lpa of the center of the addendum formation circle B, the moving start point Spb and the moving end point Lpb of the center of the dedendum formation circle C, and the distances $R_0$, $R_1$, $r_0$, and $r_1$ will be given in the following description.

In the tooth profile formed using the tooth profile of a cycloidal curve, the tooth depth, which is the sum of diameters of the internally rolling circle and the externally rolling circle, is double the amount of eccentricity between the inner rotor and the outer rotor (hereinafter simply referred to as the amount of eccentricity). Further, as described above, to establish the tooth profile, the internally rolling circle and the externally rolling circle each must move around the base circle when making the same number of rotations as the number of teeth. Thus, if the diameter of the base circle and the amount of eccentricity are determined, the number of teeth is also determined. For this reason, there is no flexibility in designing the number of teeth when the rotor size is not changed. This also applies to a tooth profile formed using a trochoidal curve. In contrast, the pump rotor of the present invention has no concept of a base circle, and the number of teeth can be determined, regardless of the base circle and the amount of eccentricity. For this reason, there is flexibility in setting the number of teeth. Hence, it is possible to reduce discharge pulsation of the pump by increasing the number of teeth.

MODES FOR CARRYING OUT THE INVENTION

Figure 1:
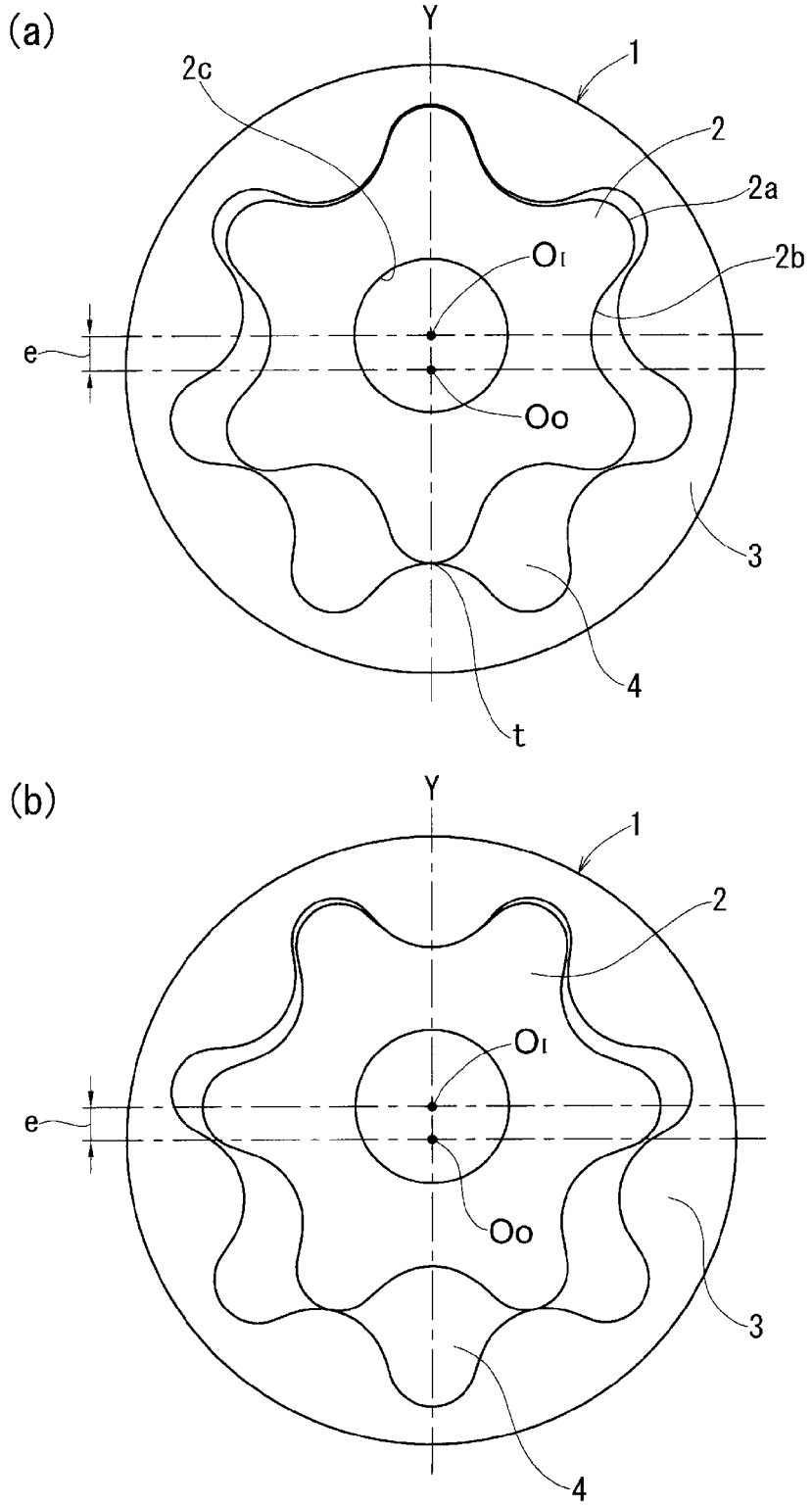
FIG. 1(*a*) is an end face view of an example of a pump rotor according to the present invention, and FIG. 1(*b*) is an end face view showing a state in which a pump chamber of the rotor is enclosed.

A pump rotor according to an embodiment of the present invention will be described below with reference to FIGS. 1 to 14 attached. A pump rotor 1 shown in FIG. 1 is formed by combining an inner rotor 2 having n-number of teeth (n=6 in the figures) and an outer rotor 3 having (n+1)-number of teeth. Reference numeral 2*a* denotes an addendum of the inner rotor 2, and 2*b* denotes a dedendum of the inner rotor 2. The inner rotor 2 has a shaft hole 2*c* in its center.

A tooth profile of the inner rotor 2 is formed using a base circle A that is concentric with the inner rotor, and a formation circle B and/or a dedendum formation circle C having a point j that is provided on the circumference thereof and passes through a reference point J serving as an intersection of the base circle A and the Y-axis. As a concrete example of a tooth profile, a combination of addendums and dedendums formed according to the following conditions is conceivable. The base circle A is a circle having a radius extending from the inner rotor center to a boundary point between the addendum and the dedendum, and the point j starts to move from a position on the circle.

Figure 2:
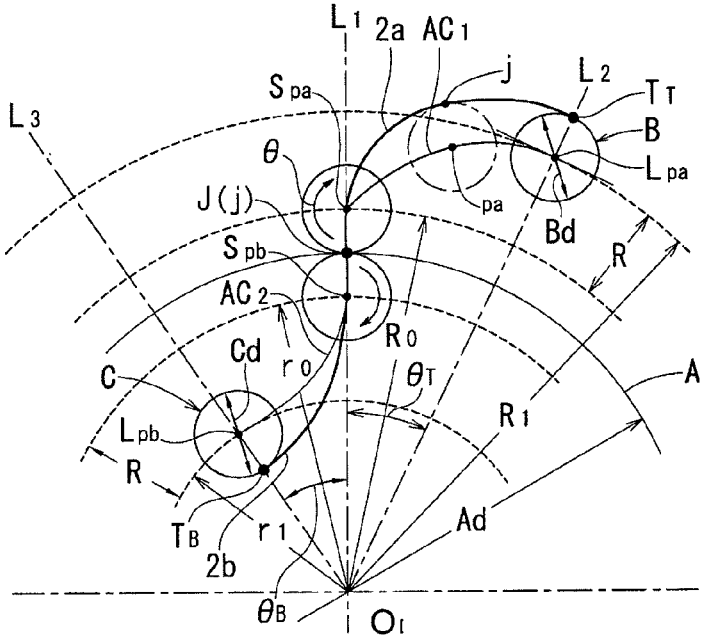
FIG. 2 is an explanatory view showing a method for forming a tooth profile of an inner rotor using formation circles having a fixed diameter.
Figure 3:
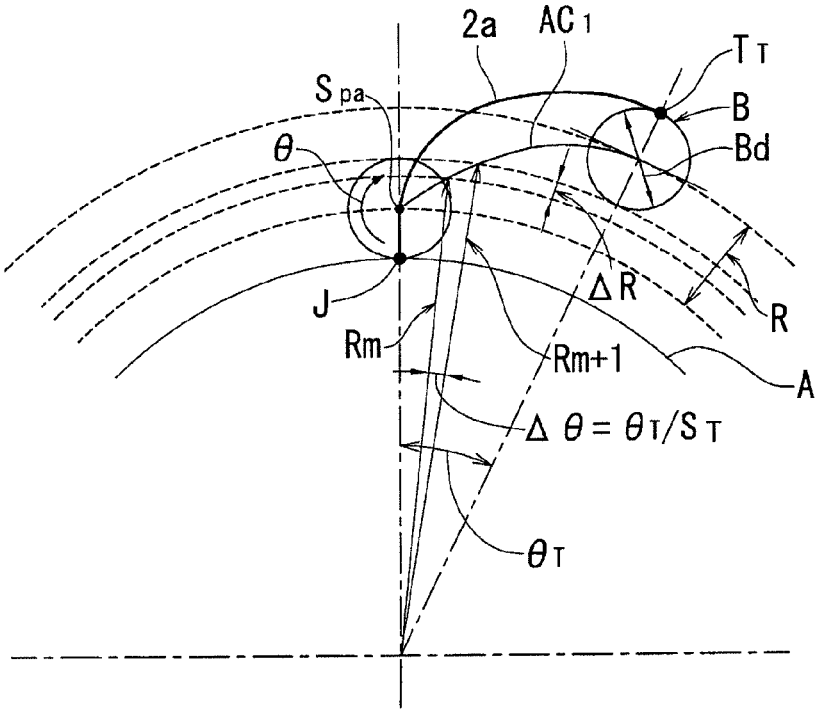
FIG. 3 is an image view showing a moving state of the center of an addendum formation circle having a fixed diameter.

It is assumed, in FIG. 2, that $L_1$ represents a straight line connecting the inner rotor center $O_I$ and the reference point J, $L_2$ represents a straight line connecting the inner rotor center $O_I$ to an addendum top $T_T$, and $\theta_T$ represents an angle $\angle SpaO_IT_T$ formed by three points, namely, a moving start point Spa of the center of the addendum formation circle B, the inner rotor center of $O_I$, and the addendum top $T_T$ (a rotation angle from the straight line $L_1$ to $L_2$).

The center pa of the addendum formation circle B moves toward the straight line $L_2$ through the angle $\theta_T$ from the moving start point Spa (this is a center position of the addendum formation circle B at a position where the point j coincides with the reference point J, and the moving start point Spa is on the straight line $L_1$ in FIG. 2) to a moving end point Lpa (this is on the straight line $L_2$). In this case, the circumferential angular velocity of the center pa of the addendum formation circle B is fixed.

During this, the center pa of the addendum formation circle B moves by a distance R in the radial direction of the base circle A.

While the center pa of the addendum formation circle B moves from the moving start point Spa to the moving end point Lpa, the addendum formation circle B rotates through an angle θ and the point j on the formation circle moves from the reference point J to the addendum top $T_T$. As illustrated at FIG. 2, the formation circle travels $\theta_T$ and a distance R from the inner rotor center $O_I$ the formation circle turns ½ rotation or 180° along θ which defines the point j on the dedendum or addendum curves. By a locus of the point j moved during this, half of a tooth profile of the addendum 2*a* of the inner rotor is drawn (also see FIG. 3).

In this case, the rotating direction of the addendum formation circle B is the same as the moving direction of the angle $\theta_T$. That is, when the rotating direction is right-handed, the moving direction of the addendum formation circle B is also right-handed.

By inverting the drawn tooth profile curve with respect to the straight line $L_2$ (so as to be symmetrical with respect to the straight line $L_2$), an addendum curve of the inner rotor is obtained.

A dedendum curve can be drawn similarly. A center pa of the dedendum formation circle C having a diameter Cd is moved from a moving start point Spb toward a moving end point Lpb through an angle $\theta_B$ while causing the dedendum formation circle C to rotate at a constant angular velocity in a direction opposite the rotating direction of the addendum formation circle B.

In this case, half of a tooth profile of the dedendum of the inner rotor is drawn by a locus formed when one point j on the circumference of the dedendum formation circle C moves from the reference point J to a dedendum bottom $T_B$ set on a straight line $L_3$. Therefore, as illustrated at FIG. 2, $\theta_B+\theta_T$ is defined by 360°/2n.

In tooth profile formation by the above-described methods, the addendum formation circle B and the dedendum formation circle C move from the moving start points to the moving end points while keeping their diameters Bd and Cd constant, and half of the tooth profile of the addendum 2*a* of the inner rotor is drawn by the locus of the point j formed during movement. However, the tooth profile forming method is not limited to these methods. The object of the present invention is also achieved by a method in which the addendum formation circle B and the dedendum formation circle C move from the moving start points to the moving end points while changing their diameters, and halves of the tooth profiles of the addendum and dedendum of the inner rotor are drawn by the loci of the points j formed during movement.

Figure 4:
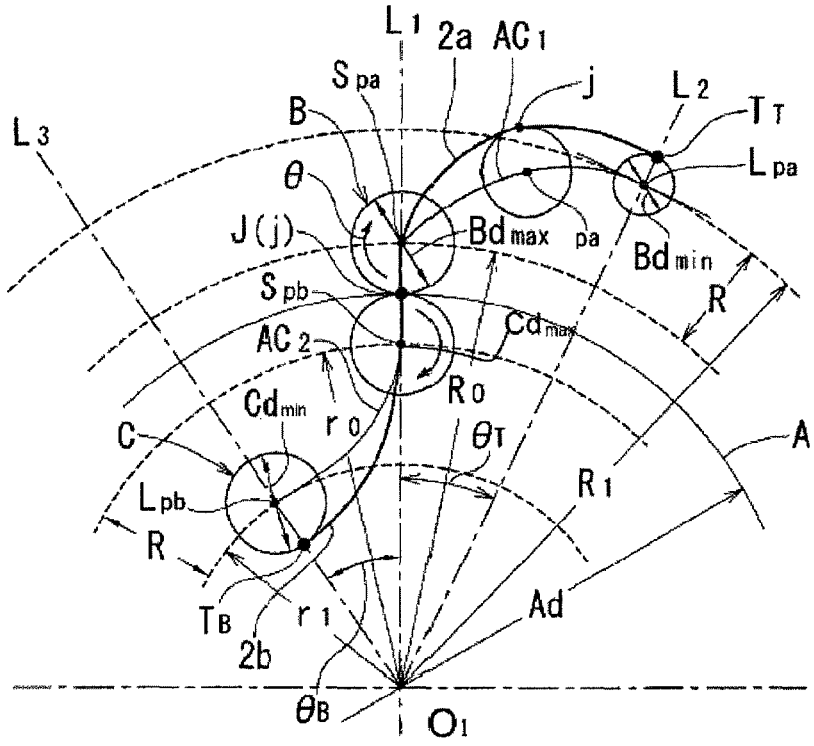
FIG. 4 is an explanatory view showing a method for forming a tooth profile of an inner rotor using formation circles whose diameters change.
Figure 5:
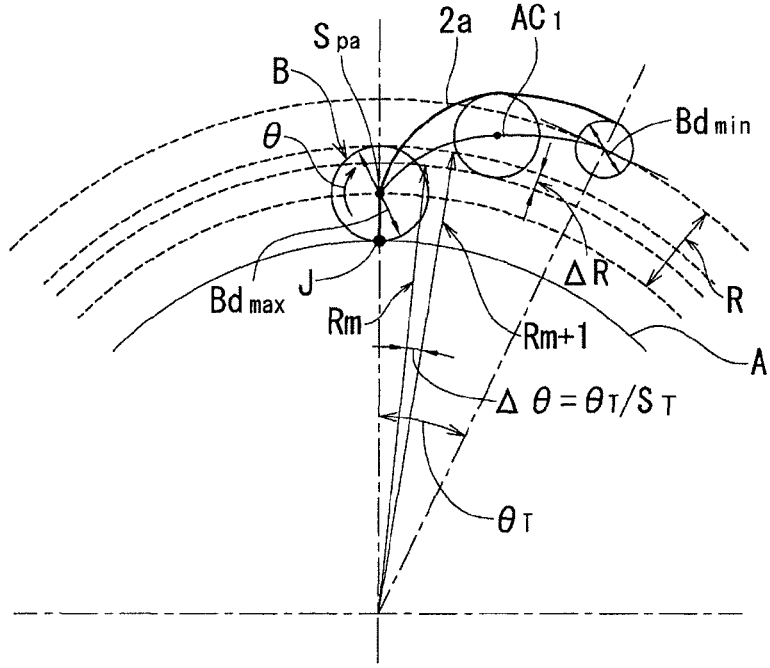
FIG. 5 is an image view showing a moving state of the center of an addendum formation circle whose diameter changes.

FIGS. 4 and 5 show the principle of formation of the tooth profile using formation circles whose diameters change.

It is assumed, in FIG. 4, that $Bd_{max}$ represents the diameter of the addendum formation circle B at the moving start point, $L_1$ represents a straight line connecting the inner rotor center $O_I$ and the reference point J, $L_2$ represents a straight line connecting the inner rotor center $O_I$ and the addendum top $T_T$, and $\theta_T$ represents an angle $\angle SpaO_IT_T$ formed by three points, namely, the moving start point Spa of the center of the addendum formation circle B, the inner rotor center $O_I$, and the addendum top $T_B$ (a rotation angle from the straight line $L_1$ to $L_2$).

The center pa of the addendum formation circle B moves toward the straight line $L_2$ through the rotation angle $\theta_T$ from the moving start point Spa to the moving end point (this is on the straight line $L_2$). In this case, the circumferential angular velocity of the center pa of the addendum formation circle B is fixed.

During this, the center pa of the addendum formation circle B moves by a distance R in the radial direction of the base circle A.

The addendum formation circle B rotates through the angle θ while decreasing its diameter during a period in which the center pa of the addendum formation circle B moves from the moving start point Spa to the moving end point Lpa. By displacement of the angle θ, the point j on the addendum formation circle B reaches the addendum top $T_T$ set on the straight line $L_2$ (this is at a position where a preset addendum circle having a diameter $D_T$ intersects the straight line $L_2$). Half of a tooth profile of an addendum 2*a* of the inner rotor is drawn by a locus formed when the point j moves during this. The diameter of the addendum formation circle B has changed to $Bd_{min}$ at the addendum top $T_T$. According to this method, the radius of curvature of the addendum can be made larger than in the tooth profile drawn using a formation circle having a fixed diameter. Further, it is possible to obtain a tooth profile in which the difference between the clearance near the tip clearance and the tip clearance is reduced.

Similarly to the case in which the tooth profile is formed using the formation circle having a fixed diameter, the rotating direction and the moving direction through the angle $\theta_T$ of the addendum formation circle B are made equal, and the tooth profile that is symmetric with respect to the straight line $L_2$ is formed by inverting the half of the tooth profile, which is drawn by the above-described method, with respect to the straight line $L_2$.

A dedendum curve can be drawn similarly. A dedendum formation circle C having a diameter Cd at a moving start point Spb is caused to rotate at a constant angular velocity in a direction opposite in the rotating direction of the addendum formation circle B, and is moved through an angle $\theta_B$ from the moving start point Spb toward a moving end point Lpb while decreasing its diameter. Half of a tooth profile of a dedendum of the inner rotor is drawn by a locus formed while one point j on the circumference of the dedendum formation circle C moves from the reference point J to a dedendum bottom $T_B$ set on the straight line $L_3$ (this is at a position where a preset dedendum circle having a diameter $D_B$ intersects the straight line $L_3$). By drawing the half tooth profile to be symmetrical with respect to the straight line $L_2$, a dedendum shape for one tooth can be obtained.

The tooth profile can be formed by the above-described methods by presetting the number of teeth n, the diameter $D_T$ of the addendum circle, the diameter $D_B$ of the dedendum circle, the angle $\theta_T$ from the straight line $L_1$ to the straight line $L_2$ ($\angle SpaO_IT_T$), the angle $\theta_B$ from the straight line $L_1$ to the straight line $L_3$ ($\angle SpbO_IT_B$), the diameters $Bd_{max}$ and $Cd_{max}$ of the addendum formation circle B and the dedendum formation circle C at the moving start points, the diameters ($Bd_{min}=Bd-\Delta B$) and ($Cd_{min}=Cd-\Delta Cd$) at the moving end points, and the curves on which the centers pa of the addendum formation circle B and the dedendum formation circle C move.

Preferably, the centers pa of the addendum formation circle B and the dedendum formation circle C move on curves $AC_1$ and $AC_2$ in which the change rate ΔR of the moving distance R is 0 at the moving end points Lpa and Lpb of the centers of the formation circles. In this case, the addendums do not become sharp, and the clearance near the tip clearance becomes stable. This achieves the effects of enhancing discharge performance (increasing the discharge amount), preventing noise during pump operation, and enhancing durability of the rotor.

Preferably, for example, the above-described curves $AC_1$ and $AC_2$ are curves using a sine function (the displacement value ΔR of the moving distance R is expressed by the following expression):

$$\Delta R = R \times \sin(\pi/2 \times m/S_T)$$

where $S_T$ is the number of steps and $m=0 \rightarrow S_T$.

By doing this, the change rate is zero when $m=S_T$, and a smooth curve can be drawn. In this case, a moving amount Δθ in the circumferential direction of the center pa of the formation circle is given as follows:

$$\Delta\theta = \theta_T / S_T$$

Besides the sine curve that is preferable, a cosine curve, a higher curve, an arc, an elliptic curve, or a curve formed by a combination of these curves and a straight line having a fixed inclination can be used for the curves $AC_1$ and $AC_2$.

When the center of the addendum formation circle B moves from the moving start point Spa to the moving end point Lpa while the addendum formation circle B decreases its diameter, preferably, the change rate of the diameter of the addendum formation circle B is preferably zero at the moving end point Lpa and Lpb of the center of the formation circle. This can easily increase the radius curvature of the addendum. For example, the displacement value Δr satisfies the following expression using a sine function:

$$\Delta r = r \times \sin(\pi/2 \times m/S_T)$$

where $S_T$ is the number of steps, and $m=0 \rightarrow S_T$, r is the difference in radius of the formation circle between the moving end point and the moving start point.

Figure 9:
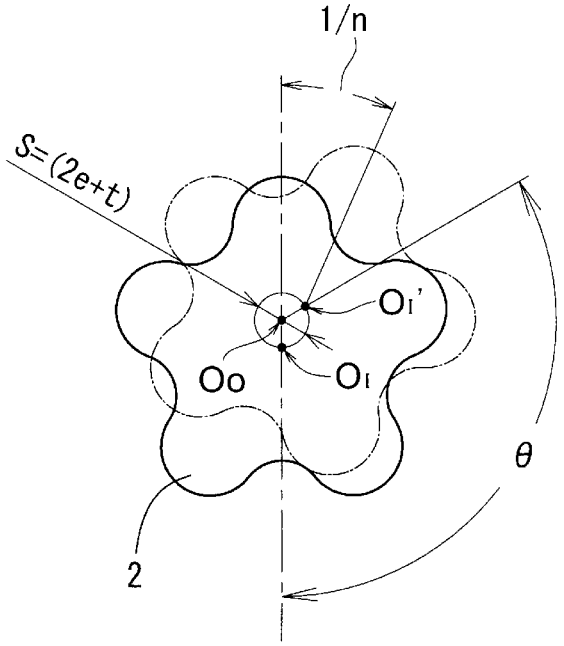
FIG. 9 is a view showing a method for forming a tooth profile of an outer rotor.

The number of teeth of the outer rotor 3 (the number of teeth is seven in FIG. 1) is larger by one than that of the inner rotor 2. A tooth profile of the outer rotor 3 is formed by the following procedure, as shown in FIG. 9. First, the center $O_I$ of the inner rotor 2 makes one revolution on a circle S centered on the center $O_O$ of the outer rotor 3 and having a diameter (2e+t). During this, the inner rotor 2 makes a 1/n rotation. An envelope of tooth profile curves formed by the revolution and rotation of the inner rotor is drawn. The envelope thus determined serves as a tooth profile.

Here:

e: amount of eccentricity between the center of the inner rotor and the center of the outer rotor t: tip clearance n: number of teeth of the inner rotor In the inner rotor 2 having addendums to which the curve that characterizes the present invention and that has been described with reference to FIGS. 2 and 3 or FIGS. 4 and 5 (hereinafter referred to as a tooth profile curve of the present invention) is applied, the shape of dedendums may be formed in a method similar to that for the addendums using the addendum formation circle C, or may adopt a tooth profile formed using a known trochoidal curve or a tooth profile using a cycloidal curve. Similarly, in the inner rotor 2 having dedendums to which the tooth profile curve of the present invention is applied, the shape of addendums may adopt a tooth profile formed using a trochoidal curve or a tooth profile using a cycloidal curve.

The tooth profile using the tooth profile curve of the present invention and the cycloidal curve in combination allows smooth engage with the outer rotor that is characteristic of the cycloidal curve, and can increase the tooth depth. The demand to increase the discharge amount is thereby satisfied.

In the tooth profile to which the tooth profile curve of the present invention is applied, the addendum height and dedendum depth of the inner rotor are determined by the value of the radial moving distance R of the addendum formation circle B and the dedendum formation circle C. Since the value of the moving distance R can be freely set in the tooth profile to which the tooth profile curve of the present invention is applied, even when one of the addendum and the dedendum has a tooth profile defined by a trochoidal curve or a cycloidal curve, the degree of flexibility in setting the tooth depth is ensured.

Figure 10:
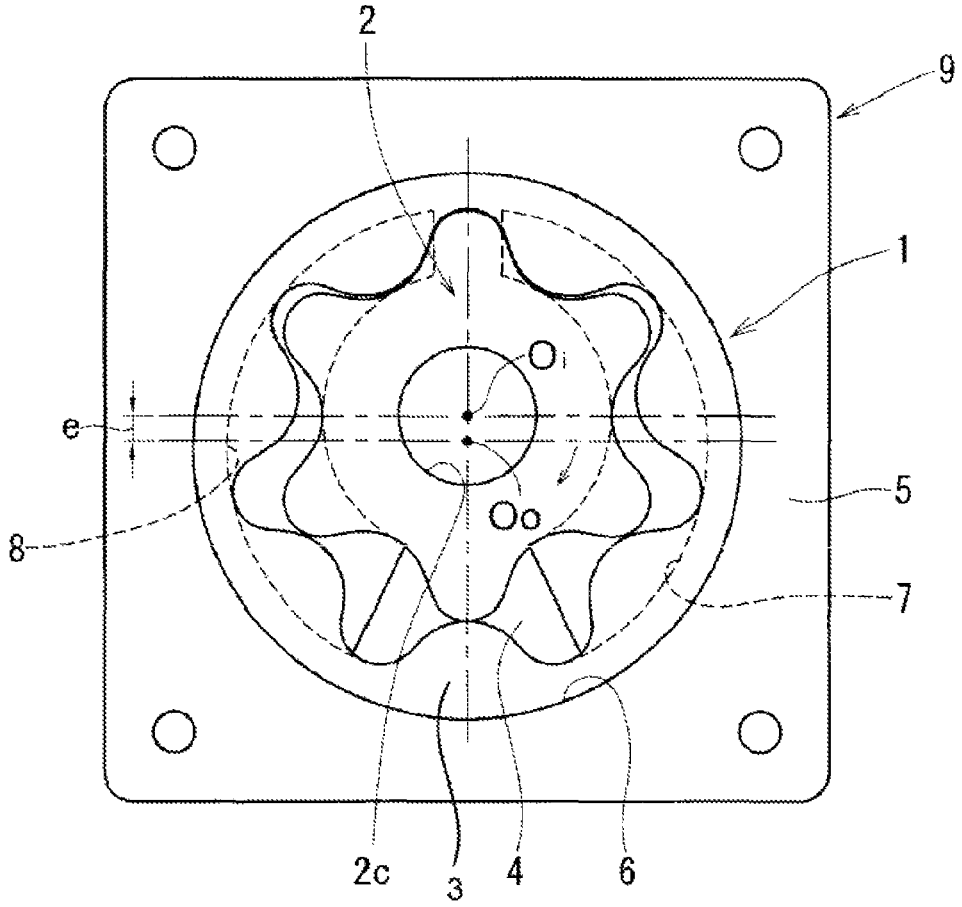
FIG. 10 is an end face view of an internal gear pump that adopts the pump rotor shown in FIG. 1, from which a cover of a housing is removed.
Figure 11:
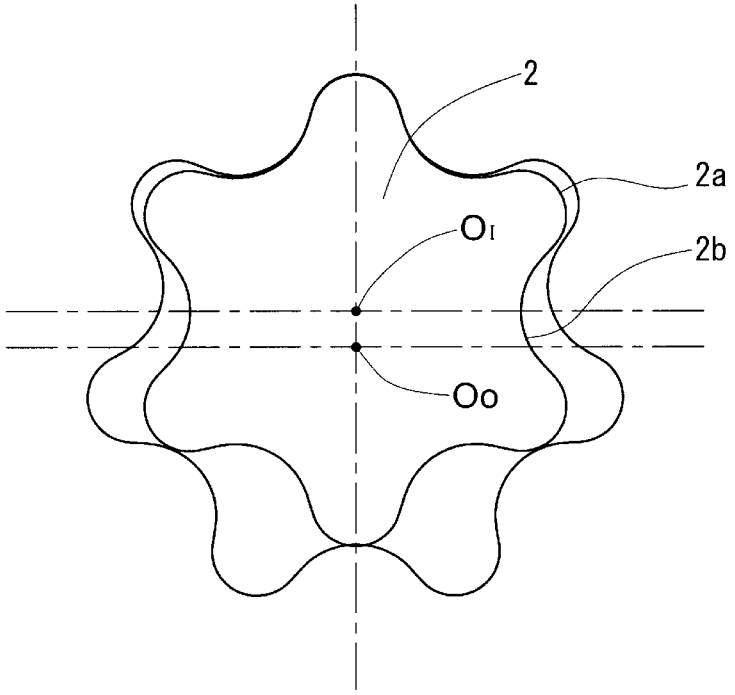
FIG. 11 is a view showing a tooth profile of a pump rotor of a first invention used in an example.
Figure 11:
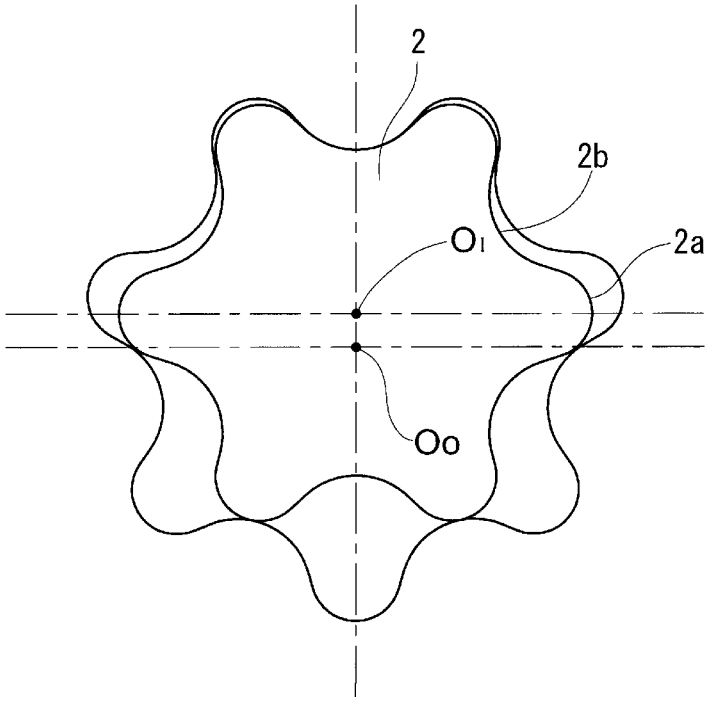
Figure 12:
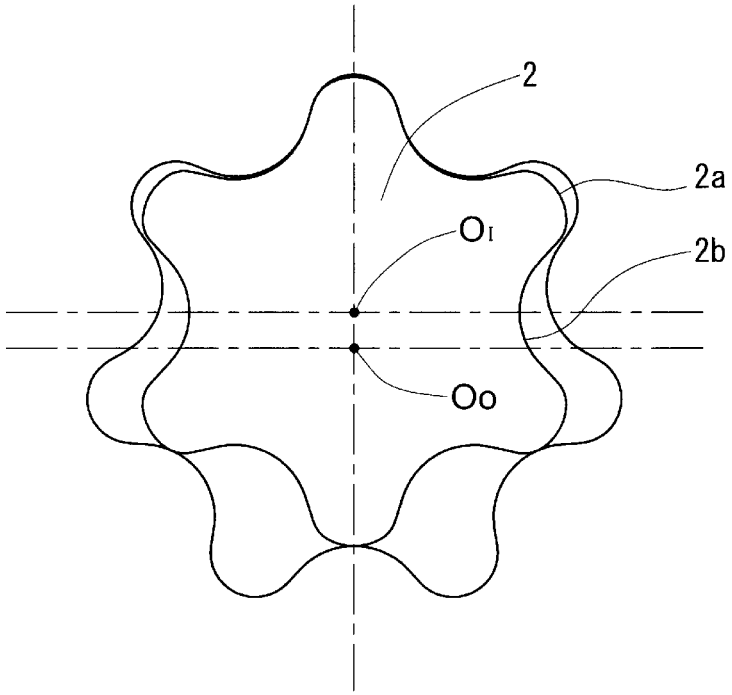
FIG. 12 is a view showing a tooth profile of a pump rotor of a second invention used in an example.
Figure 12:
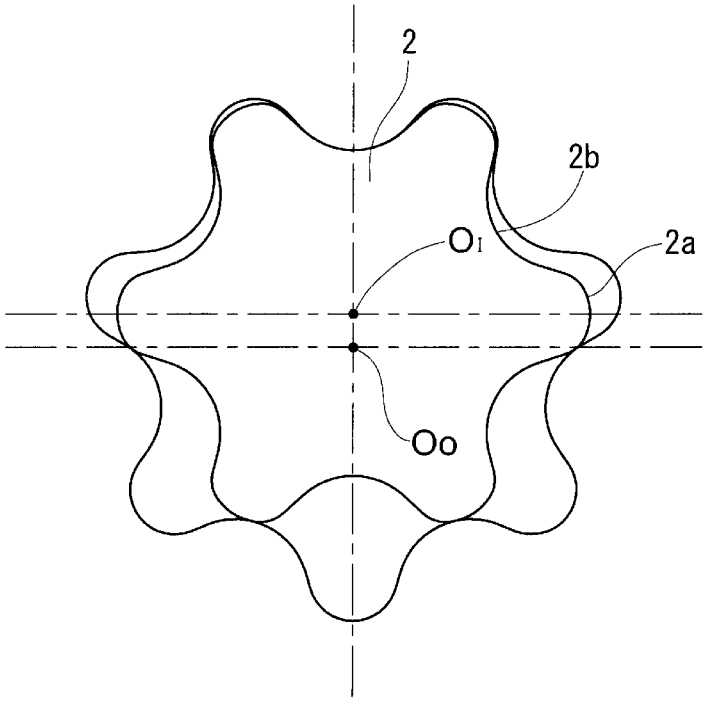
Figure 13:
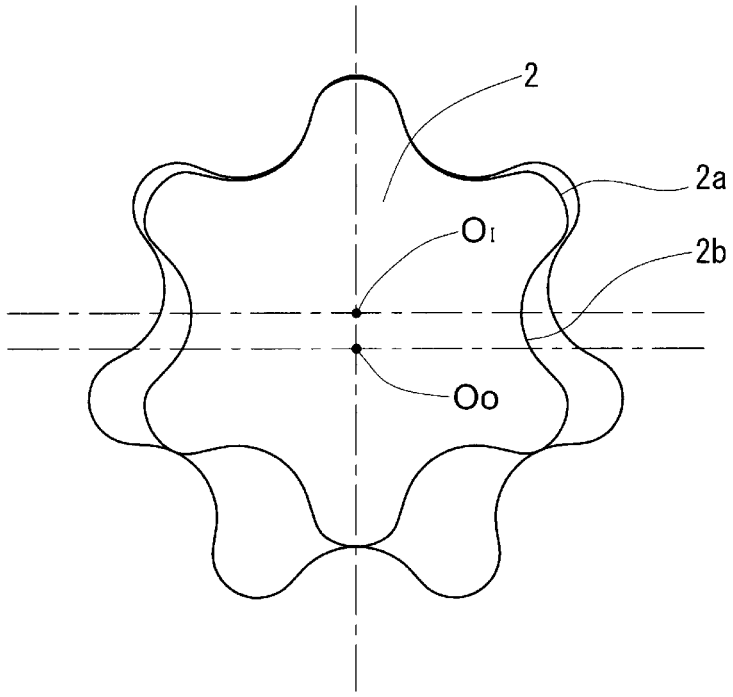
FIG. 13 is a view showing a tooth profile of a pump rotor of a third invention used in an example.
Figure 13:
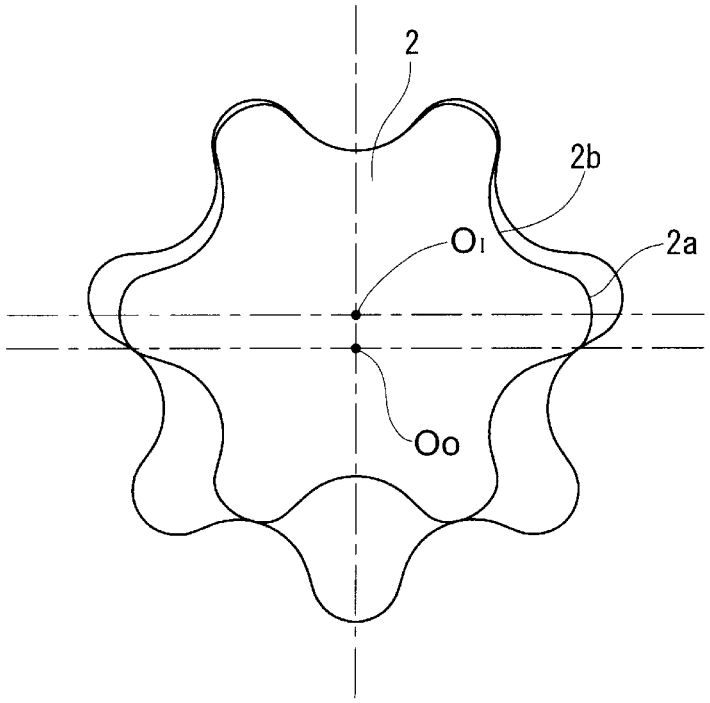
Figure 14:
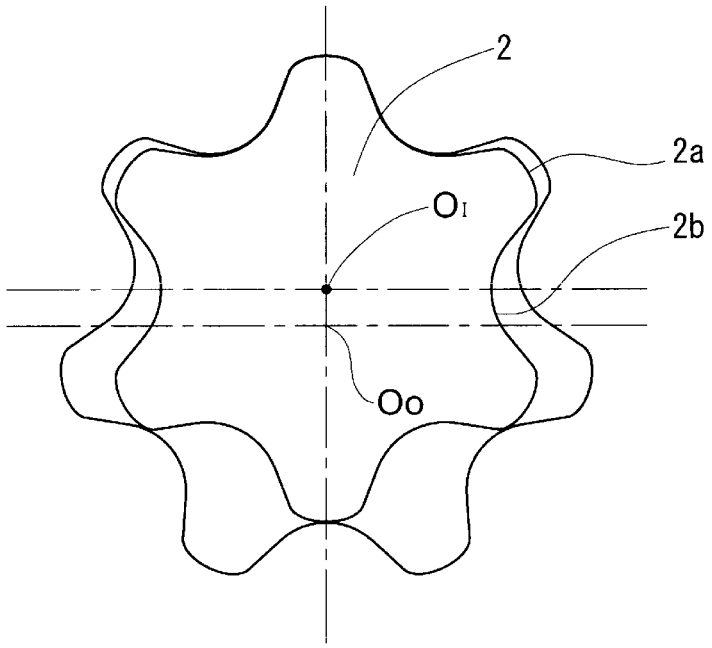
FIG. 14 is a view showing a tooth profile of a pump rotor of a fourth invention used in an example.
Figure 14:
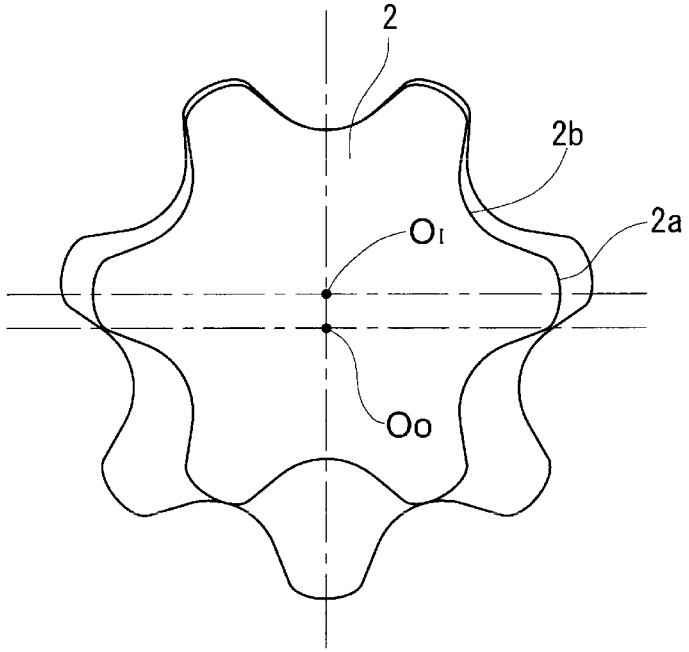
Figure 15:
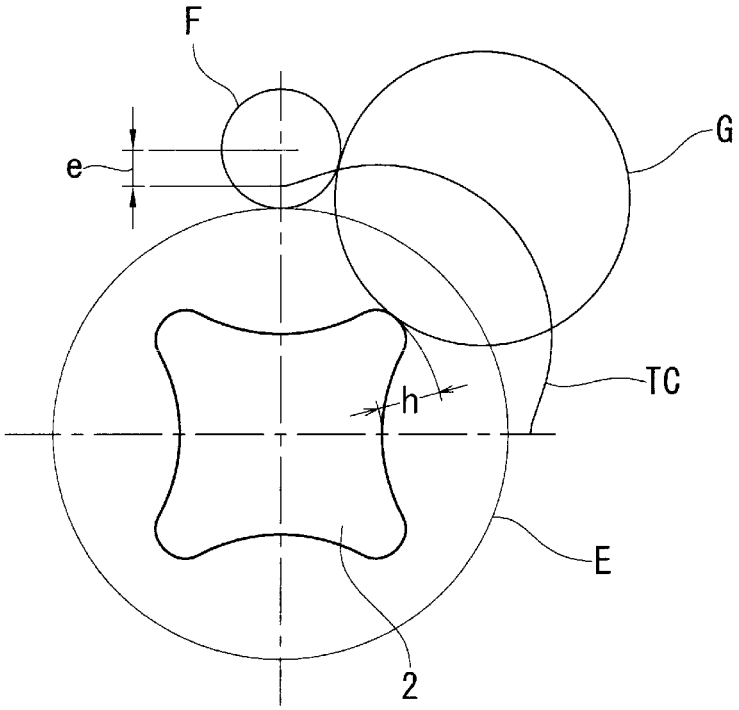
FIG. 15 is an explanatory view showing a method for forming a tooth profile using a trochoidal curve.

The inner rotor 2 and the outer rotor 3 described above are eccentrically arranged in combination to form the internal gear pump rotor 1. As shown in FIG. 10, the internal gear pump rotor 1 is stored in a rotor chamber 6 of a pump housing 5 including a suction port 7 and a discharge port 8, thereby forming an internal gear pump 9. In the internal gear pump 9, the inner rotor 2 is engaged with a driving shaft (not shown) by inserting the driving shaft in the shaft hole 2*c* of the inner rotor 2, and a driving force is transmitted from the driving shaft to rotate the inner rotor 2. In this case, the outer rotor 3 is rotated in a following manner. With this rotation, the capacity of a pump chamber 4 defined between the rotors increases and decreases, whereby fluid, such as oil, is sucked and discharged.

As described above, when the addendum of the tooth profile is formed, the center of the formation circle moves on the curve such that the distance from the inner rotor center to the center of the formation circle increases from the moving start end toward the moving terminal end. In contrast, when the dedendum of the tooth profile is formed, the center of the formation angle moves on the curve such that the distance decreases. During this, the formation circle rotates. Thus, the tooth profile of at least one of the addendum and the dedendum of the inner rotor 2 is formed by the locus of one point on the circumference of the formation circle. By doing this, the tooth depth of the inner rotor can be made larger than the tooth depth in the conventional internal gear pump that adopts a tooth profile of a trochoidal curve or a tooth profile of a cycloidal curve. For this reason, the capacity of the pump chamber 4 defined between the teeth of the inner rotor 2 and the outer rotor 3 becomes larger than in the conventional pump, and this increases the discharge amount of the pump.

Alternatively, by doing this, the number of teeth of the inner rotor can be made larger than the number of teeth of the conventional internal gear pump that adopts the tooth profile of a trochoidal curve or the tooth profile of a cycloidal curve. For this reason, the number of pump chambers 4 defined between the teeth of the inner rotor 2 and the outer rotor 3 becomes larger than in the conventional pump, and this increases the discharge amount of the pump.

Further, since the condition of tooth profile formation can be freely set, the degree of flexibility in designing the tooth profile increases. When an addendum curve or a dedendum curve of the inner rotor is formed using the addendum formation circle or the dedendum formation circle whose diameter decreases by a fixed amount per fixed rotation angle, the degree of flexibility in designing the tooth profile is particularly high because the clearance near the tip clearance can be adjusted by changing the shape of the addendum.

Figure 8:
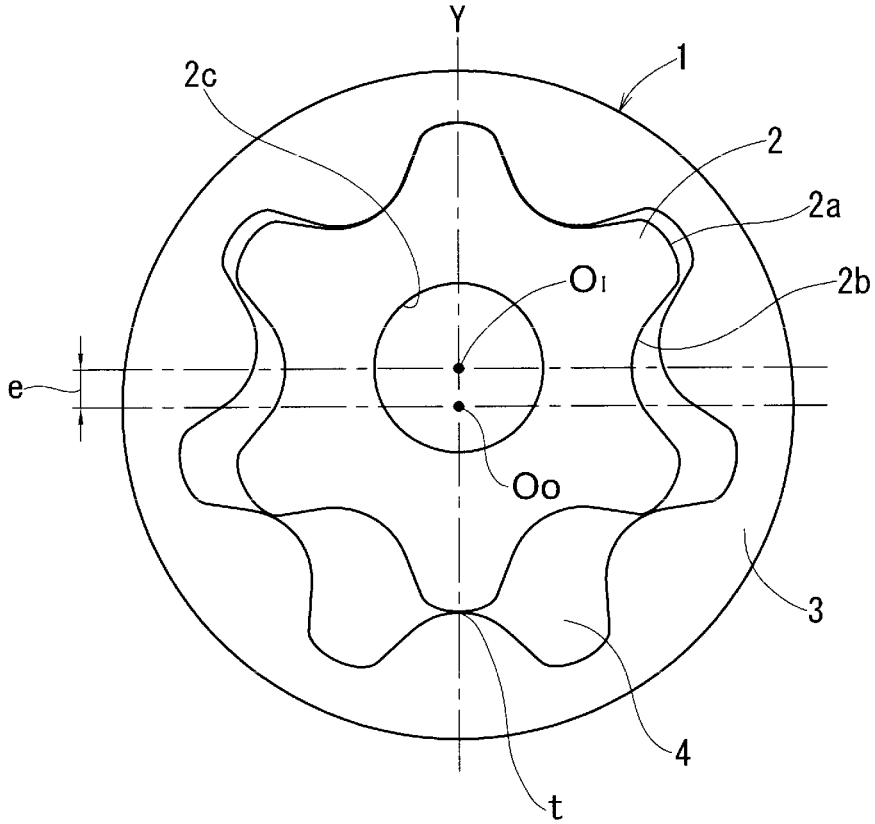
FIG. 8 is an end face view of an example of a pump rotor in which addendums of an inner rotor are formed using a formation circle whose diameter changes.

FIG. 8 shows a tooth profile drawn in the method shown in FIG. 4 by increasing the change amount in distance from the inner rotor center $O_I$ to the center of the addendum formation circle B by an amount corresponding to the reduction amount of the diameter of the addendum formation circle B while reducing the diameter of the addendum formation circle B under a condition that the addendum diameter (diameter of the addendum circle) of the inner rotor 2 is fixed. In this tooth profile, the radius of curvature of the addendum can be made larger and the clearance between the addendum and the adjacency of the addendum of the outer rotor can be made smaller than in the tooth profile of the inner rotor shown in FIG. 1 formed using the addendum formation circle B having the fixed diameter. For this reason, the capacity efficiency of the pump improves.

Figure 6:
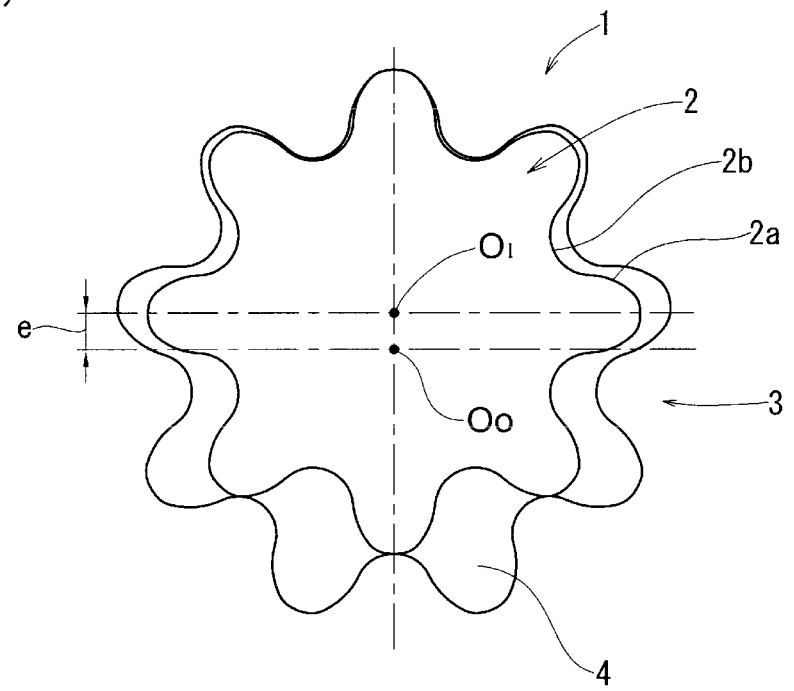
FIG. 6(*a*) is an end face view of a pump rotor according to another embodiment of the present invention (addendums of an inner rotor are formed using an addendum formation circle having a fixed diameter), and FIG. 6(*b*) is an end face view showing a state in which a pump chamber of the rotor is enclosed.
Figure 6:
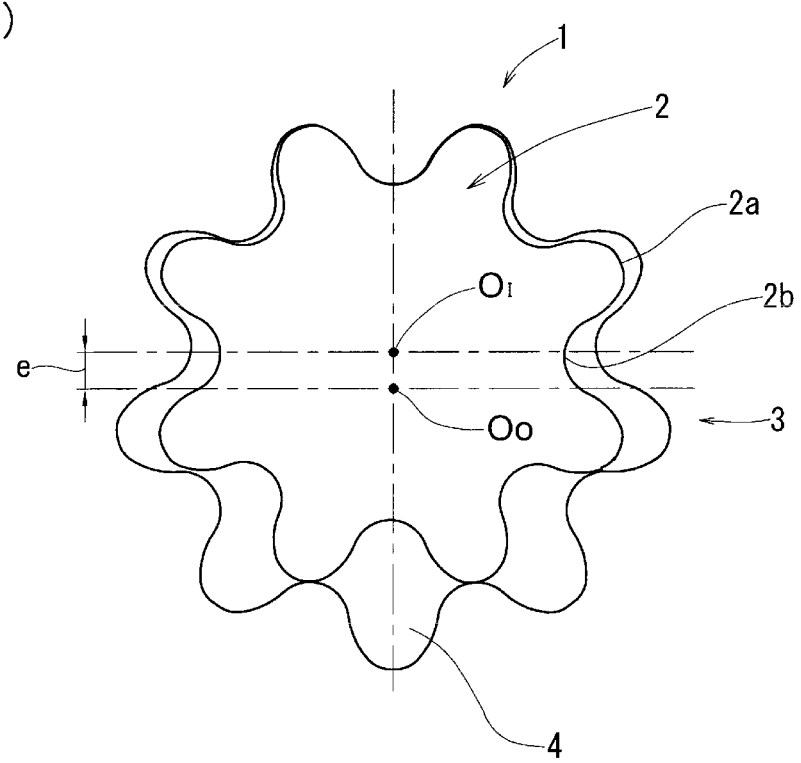
Figure 7:
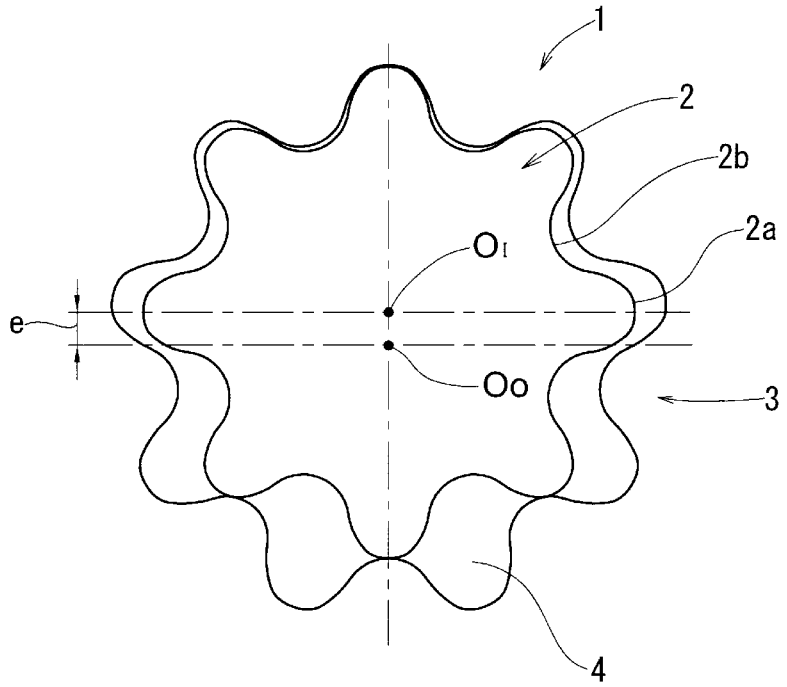
FIG. 7(*a*) is an end face view of a pump rotor according to a further embodiment of the present invention (addendums of an inner rotor are formed using an addendum formation circle having a fixed diameter), and FIG. 7(*b*) is an end face view showing a state in which a pump chamber of the rotor is enclosed.
Figure 7:
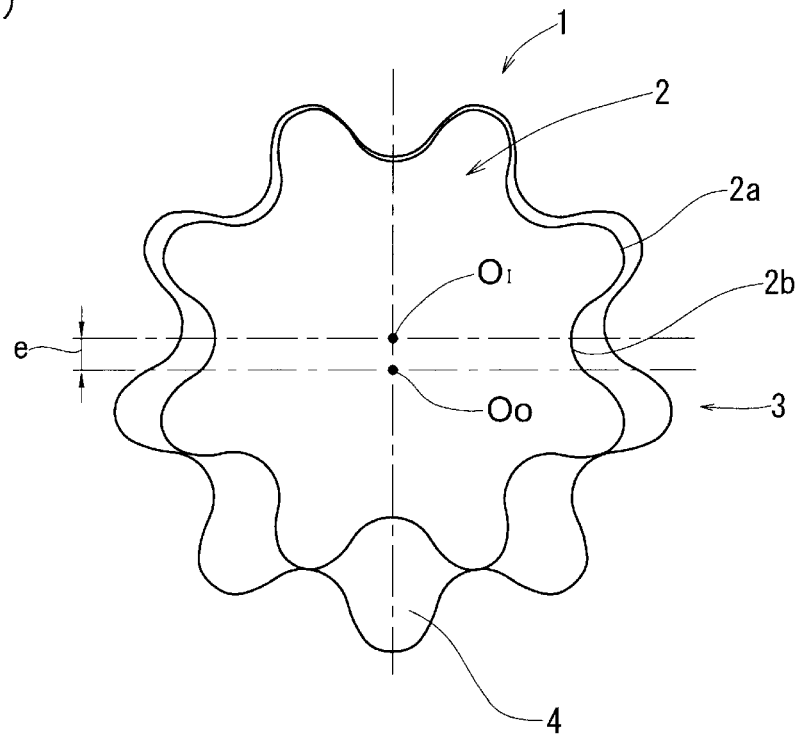

FIGS. 6 and 7 show pump rotors 1 according to other embodiments of the present invention. An internal gear pump rotor shown in FIG. 6 is designed in a manner such that the tooth profile curve of the present invention is applied to both an addendum 2*a* and a dedendum 2*b* of an inner rotor 2. In an internal gear pump rotor shown in FIG. 7, the tooth profile curve of the present invention is applied to an addendum 2*a* of an inner rotor 2, and a dedendum 2*b* is defined by a cycloidal curve. In the internal gear pump rotors shown in FIGS. 6 and 7, a formation circle having a fixed diameter is used to form the tooth profile curve of the present invention. As is seen from these embodiments, the internal gear pump rotor of the present invention has flexibility in designing the tooth profile even when the formation circle having the fixed diameter is used.

EXAMPLES

Here are results of a performance evaluation test conducted on the pump rotor of the present invention. An inner rotor having six teeth and an outer rotor having seven teeth, which were formed of an iron sintered alloy, were produced, and the rotors were combined into an internal gear oil pump rotor.

Combinations of addendum and dedendum curves of the inner rotor used in the test are follows:

First Comparative Example (see FIG. 17)
addendum curve: cycloidal curve
dedendum curve: cycloidal curve
First Invention (see FIG. 11)
addendum curve: cycloidal curve
dedendum curve: tooth profile curve of the present invention (change rate=0 at dedendum bottom)
Second Invention (see FIG. 12)
addendum curve: tooth profile curve of the present invention (change rate≠0 at addendum top)
dedendum curve: tooth profile curve of the present invention (change rate=0 at dedendum bottom)
Third Invention (see FIG. 13)
addendum curve: tooth profile curve of the present invention (change rate=0 at addendum top)
dedendum curve: tooth profile curve of the present invention (change rate=0 at dedendum bottom)
Fourth Invention (see FIG. 14)
addendum curve: tooth profile curve of the present invention (change rate=0 at addendum top, the diameter of the formation circle is changed)
dedendum curve: tooth profile curve of the present invention (change rate=0 at dedendum bottom, the diameter of the formation circle is changed)
Common specifications are as follows:
outer diameter of outer rotor: 60 mm
inner diameter of inner rotor: 15 mm
rotor thickness: 15 mm Tooth profiles were formed by the following methods. In this case, a tooth profile of any outer rotor was formed by an envelope of tooth profile curves found by the method shown in FIG. 9 using the corresponding inner rotor to be combined.

First Comparative Example

In a first comparative example, a cycloidal curve of an addendum was formed by rolling an externally rolling circle having a diameter of 3.25 mm on a base circle having a diameter of 39 mm without slipping thereon. A cycloidal curve of a dedendum was formed by rolling an internally rolling circle having a diameter of 3.25 mm on the base circle having a diameter of 39 mm without slipping thereon.

Addendum diameters (diameters of addendum circles) and dedendum diameters (diameters of dedendum circles), and the amount of eccentricity e of the formed inner and outer rotors are as follows:

addendum diameter of inner rotor: 45.5 mm
dedendum diameter of inner rotor: 32.5 mm
addendum diameter of outer rotor: 39.1 mm
dedendum diameter of outer rotor: 52.1 mm
amount of eccentricity e: 3.25 mm

[First Invention]

In a first invention, a cycloidal curve of an addendum was formed by rolling an externally rolling circle having a diameter of 2.4 mm on a base circle having a diameter of 41 mm without slipping thereon.

A tooth profile curve of the present invention at a dedendum was formed by the method shown in FIG. 2 using the base circle A and a formation circle C having a fixed diameter. In this case, specifications are as follows:

diameter Ad of base circle A: 41.0 mm
diameter Cd of formation circle C: 4.5 mm
radial moving amount R of formation circle C: 2.3 mm
displacement value ΔR of moving distance R: $2.3\times\sin(\pi/2\times m/S_T)$
number of steps $S_T$: 30
$\theta_B$: 19.5°

Addendum diameters and dedendum diameters, and the amount of eccentricity e of the formed inner and outer rotors are as follows. These numerical values are also the same in the following second, third, and fourth inventions.

addendum diameter of inner rotor: 45.1 mm
dedendum diameter of inner rotor: 31.5 mm
addendum diameter of outer rotor: 38.3 mm
dedendum diameter of outer rotor: 51.9 mm
amount of eccentricity e: 3.4 mm

[Second Invention]

In a second invention, a tooth profile curve of the present invention at an addendum was formed by the method shown in FIG. 2 using a base circle A and a formation circle B having a fixed diameter. In this case, specifications are as follows:

diameter Ad of base circle A: 40.0 mm
diameter Bd of formation circle B: 2.3 mm
radial moving amount R of formation circle B: 1.1 mm
displacement value ΔR of moving distance R: $1.1\times(m/S_T)$
number of steps $S_T$: 30
$\theta_B$: 10.5°

A tooth profile curve of the present invention at a dedendum was formed by the method shown in FIG. 2 using the base circle A and a formation circle C having a fixed diameter described with reference to FIG. 2. In this case, specifications are as follows:

diameter Ad of base circle A: 40.0 mm
diameter Cd of formation circle C: 4.3 mm
radial moving amount R of formation circle C: 2.0 mm
displacement value ΔR of moving distance R: $2.0\times\sin(\pi/2\times m/S_T)$
number of steps $S_T$: 30
$\theta_T$: 19.5°

[Third Invention]

In a third invention, a tooth profile curve of the present invention at an addendum was formed by the method shown in FIG. 2 using a base circle A and a formation circle B having a fixed diameter. In this case, specifications are as follows:

diameter Ad of base circle A: 40.0 mm diameter Bd of formation circle B: 2.3 mm radial moving distance R of formation circle B: 1.1 mm displacement value ΔR of moving distance R: $1.1\times\sin(\pi/2\times m/S_T)$ number of steps $S_T$: 30

$\theta_T$: 10.5°

A tooth profile curve of the present invention at a dedendum was formed by the method shown in FIG. 2 using the base circle A and a formation circle C having a fixed diameter. In this case, specifications are as follows:

diameter Ad of base circle A: 40.0 mm diameter Cd of formation circle C: 4.3 mm radial moving amount R of formation circle C: 2.0 mm displacement value ΔR of moving distance R: $2.0\times\sin(\pi/2\times m/S_T)$ number of steps $S_T$: 30

$\theta_T$: 19.5°

In a fourth invention, a tooth profile curve of the present invention at an addendum was formed by the method shown in FIG. 4 using a base circle A and a formation circle B whose diameter changes during movement. In this case, specifications are as follows:

diameter Ad of base circle A: 41.4 mm diameter $Bd_{max}$ of addendum formation circle B at moving start point: 2.4 mm diameter $Bd_{min}$ at moving end point: 0.6 mm displacement value of diameter of addendum formation circle: $\Delta r=1.8\times\sin(\pi/2\times m/S_T)$ radial moving distance R of center of addendum formation circle B: 0.7 mm displacement value of moving distance R: $\Delta R=0.7\times\sin(\pi/2\times m/S_T)$ number of steps $S_T$: 30

$\theta_T$: 10.5°

A tooth profile curve of the present invention at a dedendum of the fourth invention was formed by the method shown in FIG. 4 using the base circle A and a formation circle C whose diameter changes during movement. In this case, specifications are as follows:

diameter of base circle A: 41.4 mm diameter $Cd_{max}$ of dedendum formation circle C at moving start point: 4.5 mm diameter $Cd_{min}$ at moving end point: 4.0 mm displacement value of diameter of dedendum formation circle: $\Delta r=0.5\times\sin(\pi/2\times m/S_T)$ radial moving distance R of center of dedendum formation circle C: 2.9 mm displacement value ΔR of moving distance R: $2.9\times\sin(\pi/2\times m/S_T)$ number of steps $S_T$: 30

$\theta_B$: 19.5°

Internal gear pumps were constructed by incorporating, into the pump housing, the internal gear pump rotors formed by combining the inner rotors and the outer rotors having the above-described specifications. Then, discharge amounts of the pumps provided under the following test conditions were compared. The result of comparison is shown in the following Table I.

Test Conditions oil type: ATF oil temperature: 80 degrees discharge pressure: 2.5 MPa number of rotations: 3000 rpm

TABLE I

| Test result | |
|---|---|
| | Discharge amount (L/min) |
| Comparative example | 31.8 |
| First invention | 32.6 |
| Second invention | 32.7 |
| Third invention | 33.0 |
| Fourth invention | 33.5 |

Figure 16:
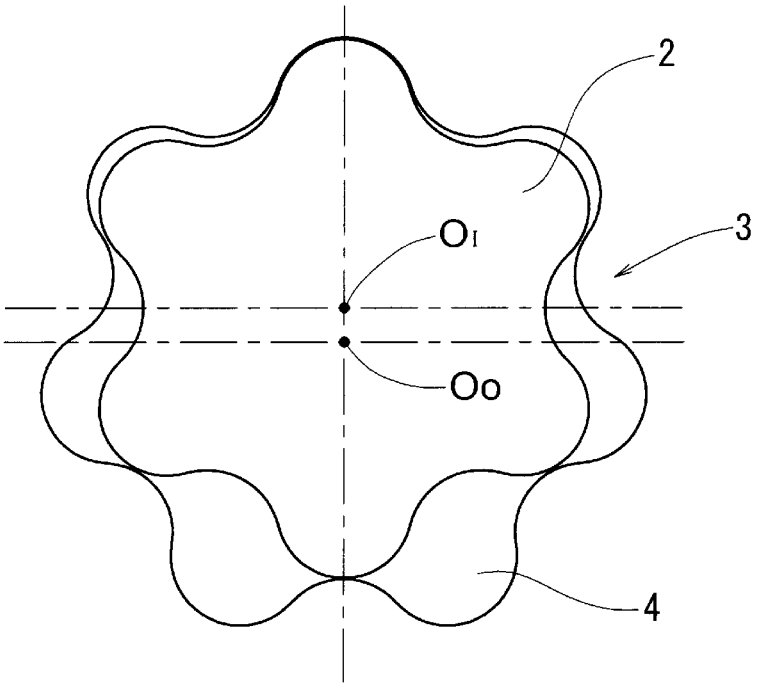
FIG. 16 is an end face view of a conventional rotor in which a trochoidal curve is used for a tooth profile of an inner rotor.
Figure 17:
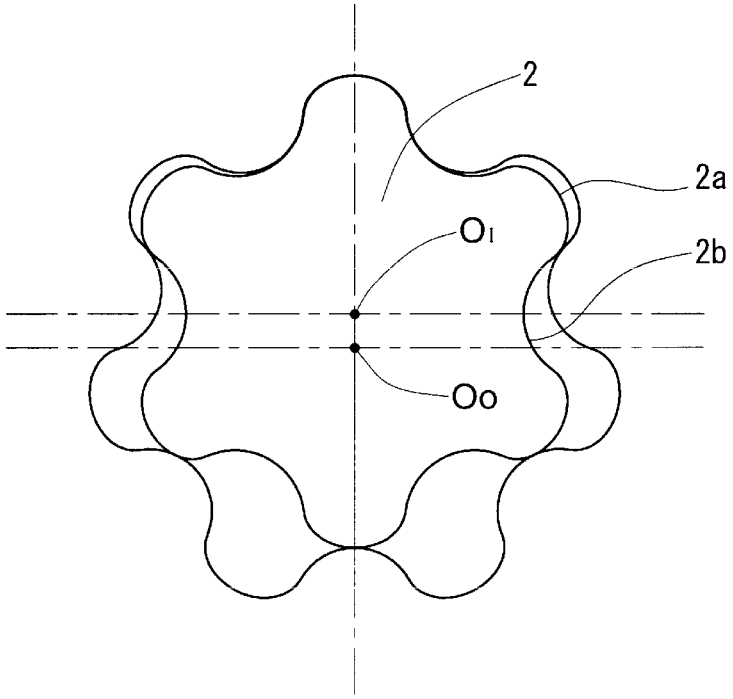
FIG. 17 is a view showing a tooth profile defined by a cycloidal curve in a pump rotor of a first comparative example used in an example.
Figure 17:
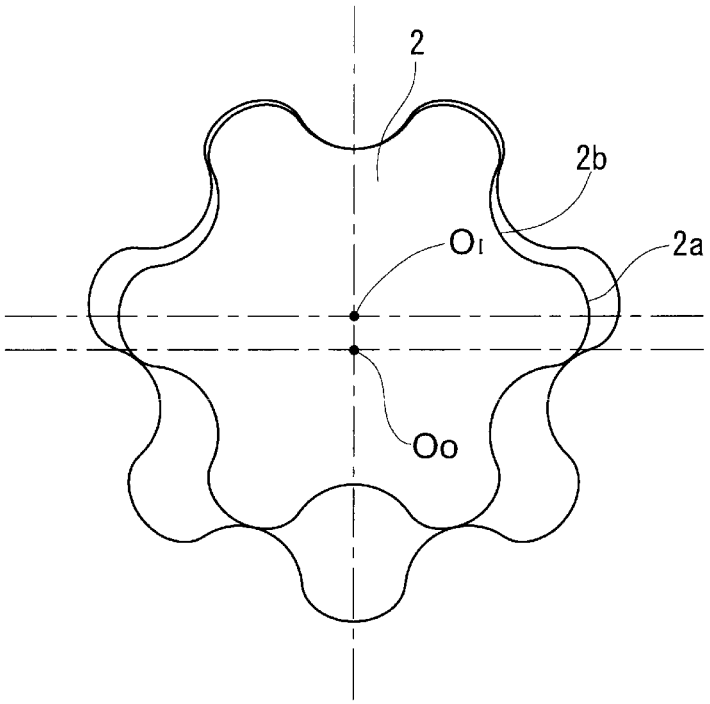

As is seen from this test result, by changing the distance R, the tooth depth of the rotor and the discharge amount of the pump can be made larger than in the conventional pump in which the tooth profile of the inner rotor is formed by a trochoidal curve (see FIG. 16) or the conventional pump in which the tooth profile is formed by a cycloidal curve (see FIG. 17). Further, since the diameter of the base circle and the diameters of the addendum formation circle and the dedendum formation circle can be freely set, the number of teeth can be freely set. Thus, discharge pulsation of the pump can be reduced by increasing the number of teeth.

In the fourth invention in which the diameter of the formation circle is gradually changed during movement, the discharge amount increases, compared with the comparative example. From this result, it is shown that the object of the present invention can be achieved even when the diameter of the formation circle changes during movement.

INDUSTRIAL APPLICABILITY

The pump rotor and the internal gear pump according to the present invention can be preferably used, for example, as oil pumps for lubrication of the car engine and for an automatic t transmission (AT).

| Reference Numerals | |
|---|---|
| 1 | pump rotor |
| 2 | inner rotor |
| 2 | addendum |
| 2b | dedendum |
| 2c | shaft hole |
| 3 | outer rotor |
| 4 | pump chamber |
| 5 | pump housing |
| 6 | rotor chamber |
| 7 | suction port |
| 8 | discharge port |
| 9 | internal gear pump |
| A | base circle |
| Ad | diameter of base circle A |
| B | addendum formation circle |
| Bd | diameter of addendum formation circle B |
| Spa | moving start point of addendum formation circle B |
| Lpa | moving end point of addendum formation circle B |
| $Bd_{max}$ | diameter of addendum formation circle B at moving start point |
| $Bd_{min}$ | diameter of addendum formation circle B at moving end point |
| ΔBd | change amount of diameter of addendum formation circle B |
| C | dedendum formation circle |
| Cd | diameter of dedendum formation circle C |
| Spb | moving start point of dedendum formation circle C |
| Lpb | moving end point of dedendum formation circle C |
| $Cd_{max}$ | diameter of dedendum formation circle C at moving start point |
| $Cd_{min}$ | diameter of dedendum formation circle C at moving end point |
| ΔCd | change amount of diameter of dedendum formation circle C |

-continued

| Reference Numerals | |
|---|---|
| $AC_1$ | curve on which center of addendum formation circle B moves |
| $AC_2$ | curve on which center of dedendum formation circle C moves |
| J | reference point on base circle A |
| j | one point on formation circle |
| $T_T$ | addendum top of inner rotor |
| $T_B$ | dedendum bottom of inner rotor |
| $L_1$ | straight line connecting center $O_I$ of inner rotor and reference point J |
| $L_2$ | straight line connecting center $O_I$ of inner rotor and addendum top $T_T$ |
| $L_3$ | straight line connecting center $O_I$ of inner rotor and dedendum bottom $T_B$ |
| $\theta_T$ | rotation angle from straight line $L_1$ to straight line $L_2$ ($\angle SpaO_IT_T$) |
| $\theta_B$ | rotation angle from straight line $L_1$ to straight line $L_3$ ($\angle SpbO_IT_B$) |
| R | radial moving distance of formation circle |
| ΔR | displacement value of distance R |
| pa | center of formation circle |
| $R_0$, $R_1$ | distance from center $O_I$ of inner rotor to center of addendum formation circle B |
| $r_0$, $r_1$ | distance from center $O_I$ of inner rotor to center of dedendum formation circle C |
| $D_T$ | diameter of addendum circle of inner rotor |
| $D_B$ | diameter of dedendum circle of inner rotor |
| e | amount of eccentricity between inner rotor and outer rotor |
| t | tip clearance |
| n | number of teeth of inner rotor |
| $O_I$ | center of inner rotor |
| $O_O$ | center of outer rotor |
| S | circle having diameter of 2e + t |
| E | base circle |
| F | rolling circle |
| TC | trochoidal curve |
| G | locus circle |

The invention claimed is:

1. An internal gear pump rotor that comprises in combination an inner rotor having n-number of teeth and an outer rotor having (n+1)-number of teeth and that sucks and discharges fluid by a change of a capacity of a pump chamber provided between the teeth of the rotors owing to rotations of the rotors, wherein formation circles move in a manner such as to satisfy the following conditions, and at least one of an addendum curve and a dedendum curve of a tooth profile of the inner rotor is formed by a locus curve drawn, during the movement, by one point that coincides with an addendum bottom or a dedendum top and a reference point on a base circle A concentric with an inner rotor center and that is on the formation circles:

While changing radial distances from the inner rotor center to centers of the formation circles by a distance, the centers of the formation circles move from moving start points where the centers are positioned when the formation circles are arranged so that the point coincides with the reference point on the base circle, to moving end points where the centers are positioned when the formation circles are arranged so that the point is positioned at an addendum top or a dedendum bottom, and the formation circles rotate through an angle of 180° at a constant angular velocity in the same direction as moving directions of the formation circles, wherein a radial distance between the moving start points and the moving end points is the distance, wherein the centers of the formation circles move from the moving start points to the moving end points while the formation circles reduce diameters thereof, and at least one of the addendum curve and the dedendum curve of the tooth profile of the inner rotor is formed by a locus curve drawn by a point on outer peripheries of the formation circles whose diameters change.

2. The internal gear pump rotor according to claim 1, wherein the centers of the formation circles having a fixed diameter move from the moving start points Spa and Spb to the moving end points Lpa and Lpb, and at least one of the addendum curve and the dedendum curve of the tooth profile of the inner rotor is formed by a locus curve drawn by a point on outer peripheries of the formation circles having the fixed diameter.

3. The internal gear pump rotor according to claim 1, wherein the centers of the formation circles move on curves where a change rate of the distances from the inner rotor center to the centers of the formation circles is 0 at the moving end points.

4. The internal gear pump rotor according to claim 3, wherein the displacement rate of the distances between the curves and the inner rotor center satisfies the following expression:

$$\Delta R = R \times \sin(\pi/2 \times m/S_T)$$

where $S_T$ is the number of steps and $m=0 \rightarrow S_T$.

5. The internal gear pump rotor according to claim 1, wherein diameters (Bd, Cd) of the formation circles (B, C) at the moving end points (Lpa, Lpb) are more than or equal to 0.2 times diameters at the moving start points (Spa, Spb) and less than or equal to the diameters at the moving start points (Spa, Spb).

6. An internal gear pump rotor comprising in combination the inner rotor according to claim 1 and an outer rotor, wherein the center of the inner rotor makes one revolution on a circle centered on a center of the outer rotor and having a diameter (2e+t), wherein, during this, the inner rotor makes a 1/n rotation, wherein an envelope of a group of tooth profile curves formed by the revolution and rotation of the inner rotor is drawn, wherein the outer rotor has the determined envelope as a tooth profile, and wherein e: amount of eccentricity between the center of inner rotor and the center of outer rotor t: tip clearance n: number of teeth of the inner rotor.

7. An internal gear pump wherein the pump rotor according to claim 1 is stored in a rotor chamber provided in a pump housing.

* * * * *